United States Patent [19]

Yagi et al.

[11] Patent Number: 5,009,988

[45] Date of Patent: Apr. 23, 1991

[54] SILVER HALIDE COLOR PHOTOGRAPHIC LIGHT-SENSITIVE MATERIAL

[75] Inventors: Toshihiko Yagi, Shiroyama; Yoshitaka Yamada, Hino, both of Japan

[73] Assignee: Konica Corporation, Tokyo, Japan

[21] Appl. No.: 571,834

[22] Filed: Aug. 24, 1990

Related U.S. Application Data

[63] Continuation of Ser. No. 168,444, Mar. 15, 1988, abandoned.

[30] Foreign Application Priority Data

Mar. 17, 1987 [JP] Japan ..... 62-61669

[51] Int. Cl.[5] ..... G03C 1/46

[52] U.S. Cl. ..... 430/505; 430/507; 430/567; 430/957

[58] Field of Search ..... 430/505, 506, 509, 567, 430/957, 507

[56] References Cited

U.S. PATENT DOCUMENTS

| | | | |
|---|---|---|---|
| 3,342,592 | 9/1967 | Chu et al. . | |
| 4,153,460 | 5/1979 | Iijima et al. . | |
| 4,450,228 | 5/1984 | Shimba et al. | 430/505 |
| 4,554,245 | 11/1985 | Hayashi et al. | 430/505 |
| 4,596,764 | 6/1986 | Ishimaru | 430/393 |
| 4,707,434 | 11/1987 | Koboshi et al. | 430/393 |
| 4,729,944 | 3/1988 | Mihayashi et al. | 430/376 |
| 4,745,048 | 5/1988 | Kishimoto et al. | 430/376 |
| 4,751,174 | 6/1988 | Toya | 430/502 |
| 4,752,558 | 6/1988 | Shimura et al. | 430/506 |
| 4,772,542 | 9/1988 | Haga | 430/505 |
| 4,804,619 | 2/1989 | Yamada et al. | 430/505 |
| 4,818,667 | 4/1989 | Hamada et al. | 430/502 |

*Primary Examiner*—Charles L. Bowers, Jr.
*Assistant Examiner*—Janet C. Baxter
*Attorney, Agent, or Firm*—Finnegan, Henderson, Farabow, Garrett, and Dunner

[57] ABSTRACT

A photographic material including a support having thereon photographic component layers including a red-sensitive emulsion layer containing a cyan coupler, a green-sensitive emulsion layer containing a magenta coupler and a blue-sensitive emulsion layer containing a yellow coupler. At least one of these silver halide emulsion layers contains a diffusible DIR compound, wherein the total dry-thickness of the photographic component layers is not greater than 16 $\mu$m and the total silver halide content of the silver halide emulsion layers is not more than 6.5 g/m$^2$ of silver. A colloidal layer, formed in a position farther from the support than the silver halide emulsion layer which is farthest from the support, contains substantially non-light-sensitive fine grain silver halide grains.

17 Claims, No Drawings

SILVER HALIDE COLOR PHOTOGRAPHIC LIGHT-SENSITIVE MATERIAL

This application is a continuation of application Ser. No. 168,444, filed Mar. 15, 1988, now abandoned.

FIELD OF THE INVENTION

This invention relates to a silver halide colour photographic light-sensitive material and, more particularly, to a silver halide colour photographic light-sensitive material excellent in sharpness and colour reproducibility.

BACKGROUND OF THE INVENTION

Generally speaking, a silver halide colour photographic light-sensitive material, hereinafter sometimes called simply a light-sensitive material, is comprised of a support bearing thereon a red light-sensitive silver halide emulsion layer containing a cyan coupler, a green light-sensitive silver halide emulsion layer containing a magenta colour developing coupler and a blue light-sensitive silver halide emulsion layer containing a yellow colour developing coupler and, besides the above, an antihalation layer, an interlayer, a filter layer, a protective layer and so forth, if required. Recently in light-sensitive materials, while users' demands have been increased for improving image quality, it is found that smaller formats have been evolved. Therefore, the demands for high quality images have been increased more than ever, so that a great deal of effort have so far gone thereinto.

As for the optical aspects, it has been known that a silver halide emulsion capable of scattering rays of light is used as a monodisperse type silver halide emulsion and the grain size thereof is controlled, or that the whole amount of light-sensitive silver halide emulsions are reduced to not more than 10 $g/m^2$ (in terms of the Ag content thereof), and so forth.

Further, similar to the above, the techniques for thinning photographic component layers have been studied from the viewpoint of shortening a path of light scattered.

Particularly in the case of a silver halide emulsion layer closer to a support than others, a pass of light scattered from the surface of a light-sensitive material will be longer. It has been known that the techniques for thinning a layer by the reduction of a binder content is one of the effective measures for improving sharpness. These techniques are described in, for example, Journal of the Optical Society of America, 58 (9), pp. 1245–1256, 1968; Photographic Science and Engineering, 16 (3), pp. 181–191 , 1972; and so forth.

Further, as to the typical measures, there are known measures, such as the simple reduction of gelatin amount, the reduction of the amount of couplers coated, the reduction of the amount of high boiling solvent for dispersing couplers, the use of the so-called polymer couplers, and so forth.

On the other hand, as to the methods for improving sharpness from the aspect of development effects, there are known methods in which a diffusible DIR compounds are used, such as those described in Japanese Patent Publication Open to Public Inspection (hereinafter called Japanese Patent O.P.I. PublicatiOn) Nos. 131934-1984 and 154234-1982 or Japanese Patent Publication No. 27738-1986 and so forth.

When a sharpness is increased by making photographic component layers thinner and the sharpness is further tried to be improved by adding the above-mentioned diffusible DIR compound, there raises a new problem that a colour reproducibility is seriously deteriorated and, in particular, yellow colour is mixed into red and green colours, so that a trouble is caused in practical use.

SUMMARY OF THE INVENTION

It is an object of the invention to provide a silver halide colour photographic light-sensitive material excellent in sharpness and colour reproducibility.

The above-mentioned object of the invention can be accomplished with a silver halide colour photographic light-sensitive material comprising a support having thereon photographic component layers including a red light-sensitive silver halide emulsion layer containing a cyan coupler, a green light-sensitive silver halide emulsion layer containing a magenta coupler and a blue light-sensitive silver halide emulsion layer containing a yellow coupler and at least one of the silver halide emulsion layers contains a diffusible DIR compound, wherein a total dry-thickness of the photographic component layers is not thicker than 16 μm and the whole silver halide content of the silver halide emulsion layers is not more than 6.5 $g/m^2$ in terms of silver and, a colloidal layer, formed in a position farther from the support than the silver halide emulsion layer which are farthest from the support, contains substantially non-light-sensitive fine grain silver halide grains.

DETAILED DESCRIPTION OF THE INVENTION

In this invention, a total dried thickness of the photographic component layers is not thicker than 16 μm. The words, 'photographic component layers', used herein include such a component layer as a red light-sensitive silver halide emulsion layer, a green light-sensitive silver halide emulsion layer and a blue light-sensitive silver halide emulsion layer and, besides, an interlayer, a filter layer, a protective layer and so forth which may be provided if required, but not including a support. The above-mentioned dried layer thickness means a layer thickness measured under the conditions of a temperature of 23° C. and an adjusted humidity of 55% RH. The layer thickness may be measured in such a manner that the section of a dried sample is magnified by a scanning type electron microscope and the magnified section is photographed. In this measurement method, the layer thickness of each component layer may be obtained individually, even in a multilayered structure.

The thinner limit of the above-mentioned photographic component layers is limitative, because of the volume occupied by silver halide emulsions which are to be contained in the emulsion layers, oily substances such as couplers and so forth, additives, binders such as gelatin and so forth. The total dried thickness of the photographic component layers, hereinafter sometimes called $D_T$, is preferably from 5 μm to 15 μm and, more preferably, from 10 μm to 15 μm. The thickness from the upper surface of the emulsion layer furthest from a support to the lower surface of the emulsion layer nearest to the support hereinafter called $D_{EM(T)}$ is preferably not thicker than 14 μm.

The thickness from the upper surface of the above-mentioned furthest emulsion layer to the lower surface of an emulsion layer which is the second nearest to the support and is different in colour sensitivity from that of the nearest layer to the support hereinafter called $D_{EM(U)}$, is preferably not thicker than 10 μm.

In the light-sensitive materials relating to the invention, the total contents of the silver halides of light-sensitive silver halide emulsions contained in the whole emulsion layer are not more than 6.5 g/m$^2$; preferably, from 3.0 to 6.0 g/m$^2$; more preferably, from 3.5 to 5.5 g/m$^2$; and, particularly, from 4.0 to 5.0 g/m$^2$.

An amount of the silver halide emulsions may be determined in a fluorescent X-ray method, and the above-mentioned silver halide content is expressed in terms of the silver content thereof.

Next, the silver halide emulsions forming a light-sensitive layer will be described. In order to prepare the above-mentioned silver halide emulsions, it is allowed to use any kinds of silver halides which are applied to ordinary silver halide emulsions. Among the silver halide emulsions, particularly preferable ones are those containing silver iodobromide. In order to serve as the silver halide emulsions, it is allowed to use any one of such an emulsion as those having a wide grain size distribution, which is called a polydisperse type emulsion; such an emulsion as independent ones each having a narrow grain size distribution, which is called a monodisperse type emulsion, or in the form of the mixture thereof; such an emulsion as those mixed with the polydisperse type emulsions and the monodisperse type emulsions together; and, preferably, the monodisperse type emulsions. The word, 'monodispersibility' of the monodisperse type emulsions used hereinafter means the characteristics of an emulsion whose variation coefficient is not higher than 22% and, more preferably, not higher than 15%, in the grain size distribution of silver halide grains contained in an emulsion. Such a variation coefficient means a coefficient expressing the wideness of a grain size distribution and is defined as the following equations.

$$\text{Variation coefficient} = \frac{\text{Standard deviation of grain size distribution}}{\text{Average grain size}} \times 100\%$$

$$\text{Standard variation of grain size distribution} = \sqrt{\frac{\Sigma(\bar{r} - ri)^2 ni}{\Sigma ni}}$$

$$\text{Average grain size} = \frac{\Sigma niri}{\Sigma ni} = \bar{r}$$

wherein ri represents the grain size of individual grains; ni represents the number of the grains; in the case of cubic-shaped silver halide grains, average grain size $\bar{r}$ means an average value of the lengths of one side of the cubic grains and, in the case of spherical-shaped grains or the like, average grain size $\bar{r}$ means an average value obtained by converting the grain sizes into the lengths of one side of cubic-shaped grains; and, when the grain sizes of individual grains is ri and the number of the grains is ni, a variation coefficient may be expressed by the above-given equations.

The above-mentioned grain sizes may be measured in various methods which are generally used in the art for the same purpose. The typical methods thereof are described in, for example, r.p. Loveland, 'Particle Size Measurement', A.S.T.M. Symposium on Light Microscopy, 1955, pp. 94–122; or C.E.K. Mees and T. H. James, 'The Theory of the Photographic Process', 3rd Ed., Ch. 2, The Macmillan Co., 1966.

Whereas, the above-mentioned green light-sensitive layer contains magenta couplers. As for the magenta couplers, there are publicly known couplers such as those of each type of 5-pyrazolone, pyrazolobenzimidazole, pyrazolotriazole and open-chained acylacetonitrile, which may preferably be used.

Red light-sensitive layer contains cyan couplers. As for the cyan couplers, there are those of the naphthol type and the phenol type, which may preferably be used.

Blue light-sensitive layer contains yellow coulers including, for example, those of the acylacetanilide type, which may preferably be used. Among these, the compounds of the benzoylacetanilide type and the pivaloylacetanilide type are suitable for the purpose.

Thanks to the technical developments of high colour forming couplers, it has further been accelerated to make light-sensitive layers thinner. The high colour forming couplers have been reported variously. These couplers include, for example, polymer couplers described in Japanese Patent O.P.I. Publication No. 36249-1984, pyrazolotriazole type agenta couplers and benzoyl type yellow couplers each described in Japanese Patent Application No. 88394-1985, and so forth. It is, therefore, preferred to use such a high colour forming coupler as a means for making layers thinner.

Further in this invention, at least one of the above-mentioned light-sensitive silver halide emulsions contains a diffusible DIR compound. It is preferred to contain the diffusible DIR compound in all of the emulsion layers to make the image quality of the emulsion layers.

In this invention, a diffusible DIR compound means having either a development inhibitor or a compound capable of releasing the development inhibitor, each of which is capable of splitting off upon reaction with the oxidized product of a colour developing agent, and has a diffusibility of not less than 0.40 according to the undermentioned evaluation method.

Such diffusibility may be measured in the following method.

Samples I and II of light-sensitive materials are so prepared as to coat the layers having the following compositions over to a transparent support.

Sample I: A sample having a green-sensitive silver halide emulsion layer

A gelatin coating solution is so prepared as to contain spectrally green-sensitized silver iodobromide having a silver iodide content of 6 mole % and an average grain size of 0.48 μm and the following coupler in an amount of 0.07 mole per mole of silver. The resulted coating solution is coated in terms of silver coated in an amount of 1.1 g/m$^2$ and of gelatin added in an amount of 3.0 g/m$^2$. Over to the resulted layer is then coated with another gelatin solution containing silver iodobromide which was sensitized neither chemically nor spectrally but has a silver iodide content of 2 mole % and an average grain size of 0.08 μm, in terms of silver coated in an amount of 0.1 g/m$^2$ and of gelatin added in an amount of 0.8 g/m$^2$, so as to serve as a protective layer.

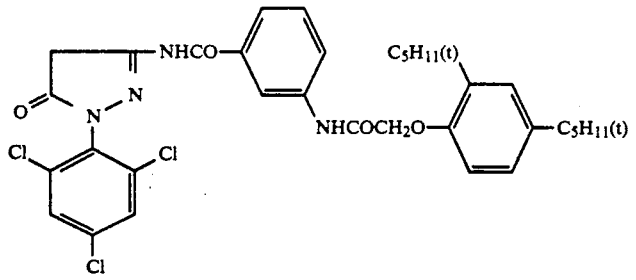

Sample II: A sample omitting silver iodobromide from the protective layer of the above-given Sample I Each layer of this sample further contains a gelatin hardener and a surface active agent, in addition to the compositions of the aforementioned sample.

Sample I and II are exposed to white light through a wedge and then processed in the following processing steps. As for the developers, two kinds of developers are used, respectively, namely, one added with various development inhibitors in an amount capable of inhibiting the sensitivity of Sample II to 60%, that is a value of $-\Delta\log E=0.22$, and the other not added with any development inhibitor.

| Processing step at 38° C. | |
|---|---|
| Colour developing | 2 min 40 sec. |
| Bleaching | 6 min 30 sec. |
| Washing | 3 min 15 sec. |
| Fixing | 6 min 30 sec. |
| Washing | 3 min 15 sec. |
| Stabilizing | 1 min 30 sec. |
| Drying | |

The compositions of the processing solutions used in the processing steps are as follows.

| <Colour developer> | |
|---|---|
| 4-amino-3-methyl-N-ethyl-N-(β-hydroxyethyl)-aniline · sulfate | 4.75 g |
| Sodium sulfite, anhydrous | 4.25 g |
| Hydroxylamine · ½ sulfate | 2.0 g |
| Potassium carbonate, anhydrous | 37.5 g |
| Sodium bromide | 1.3 g |
| Trisodium · nitrilotriacetate, monohydrate | 2.5 g |

-continued

| | |
|---|---|
| Potassium hydroxide | 1.0 g |
| Add water to make | 1 liter |
| <Bleacher> | |
| Iron ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Add water to make | 1 liter |
| Adjust pH with aqueous ammonia to | 6.0 |
| <Fixer> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to | 6.0 |
| <Stabilizer> | |
| Formalin in a 37% aqueous solution | 1.5 ml |
| Koniducks (manufactured by Konishiroku Photo Ind. Co., Ltd.) | 7.5 ml |
| Add water to make | 1 liter |

Provided that $S_O$ denotes the sensitivity of Sample I and $S_0'$, that of Sample II, respectively, when no development inhibotor is added; and $S_I$ denoted the sensitivity of Sample I and $S_{II}$, that of Sample II, respectively, when a development inhibitor is added; it may be expressed that Desensitization degrees of Sample I $=\Delta S=S_0-S_I$, Desensitization degrees of Sample II $=\Delta S_0=S_0'-S_{II}$ Diffusibility $=\Delta S/\Delta S_0$ wherein every sensitivity is regarded as $-\log E$, that is, the cologarithm of an exposure in a density point of fog density plus 0.3.

The diffusibilities of several kinds of development inhibitors obtained in the above-mentioned method will be exemplified in the following table.

TABLE

| Structure | Amount added (mole/liter) | Desensitization degree $\Delta S_0$ | Desensitization degree $\Delta S$ | Diffusibility $\Delta S/\Delta S_0$ |
|---|---|---|---|---|
| 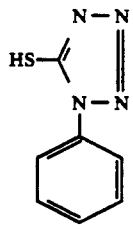 | $1.3\times10^{-5}$ | 0.22 | 0.05 | 0.23 |

TABLE-continued

| Structure | Amount added (mole/liter) | Desensitization degree $\Delta S_0$ | Desensitization degree $\Delta S$ | Diffusibility $\Delta S/\Delta S_0$ |
|---|---|---|---|---|
| 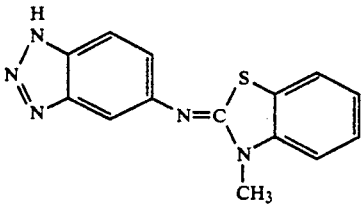 | $1.3 \times 10^{-5}$ | 0.23 | 0.08 | 0.34 |
| 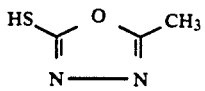 | $2.5 \times 10^{-5}$ | 0.22 | 0.10 | 0.45 |
| 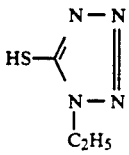 | $3.0 \times 10^{-5}$ | 0.21 | 0.10 | 0.48 |
| 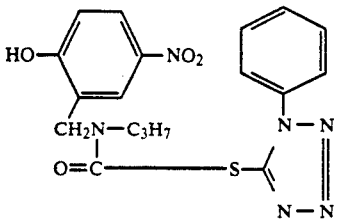 | $1.4 \times 10^{-5}$ | 0.23 | 0.11 | 0.48 |
| 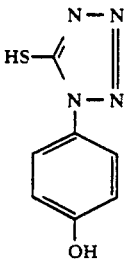 | $2.5 \times 10^{-5}$ | 0.22 | 0.13 | 0.59 |
| 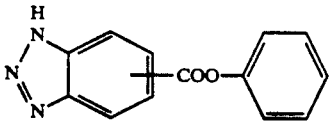 | $3.5 \times 10^{-5}$ | 0.23 | 0.15 | 0.65 |
| 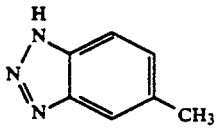 | $4.3 \times 10^{-5}$ | 0.22 | 0.16 | 0.73 |
| 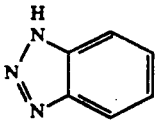 | $1.7 \times 10^{-4}$ | 0.21 | 0.20 | 0.95 |

As the diffusible DIR compounds of the invention, any one of them may be used regardless of their chemical structures, as far as the diffusibility of a released group is within the above-mentioned range.

The typical structural formula will be give below.

A—(Y)m (D-1)

wherein A represents a coupler residual group, m is an integer of 1 or 2, and Y represents a development inhibiting group having a diffusibility of not less than 0.40 or a group capable of releasing a development inhibitor, each of which is bonded to the coupling position of the coupler residual group A so as to be able to split off upon reaction with the oxidized product of a colour developing agent.

In Formula D-1, Y may be typically represented by the following formulas D-2 through D-19.

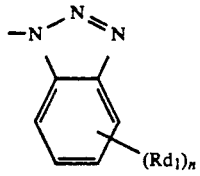
Formula D-2

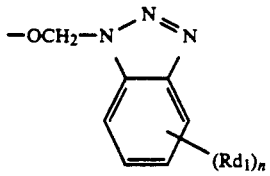
Formula D-3

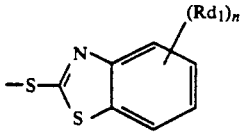
Formula D-4

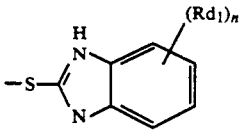
Formula D-5

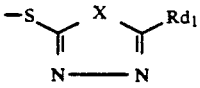
Formula D-6

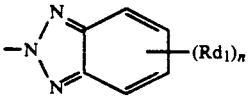
Formula D-7

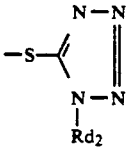
Formula D-8

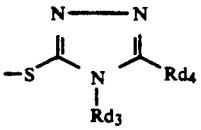
Formula D-9

In the above-given Formulas D-2 through D-7, $Rd_1$ represents a hydrogen atom, a halogen atom or a group of alkyl, alkoxy, acylamino, alkoxycarbonyl, thiazolylideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl or aryloxycarbonylamino; and n is an integer of 0, 1 or 2 and, when n is 2, $Rd_1$s may be the same with or different from each other. The total number of carbon atoms contained in n of $Rd_1$ is from 0 to 10. In Formula D-6, the number of carbon atoms contained in $Rd_1$ is from 0 to 15.

In the above Formula D-6, X represents an oxygen atom or a sulfur atom.

In Formula D-8, $Rd_2$ represents an alkyl, aryl or heterocyclic group.

In Formula D-9, $Rd_3$ represents a hydrogen atom or a group of alkyl, cycloalkyl, aryl or heterocyclic group; and $Rd_4$ represents a hydrogen atom, a halogen atom, or a group of alkyl, cycloalkyl, aryl, acylamino, alkoxycarbonylamino, aryloxycarbonylamino, alkane sulfonamido, cyano, heterocyclic, alkylthio or amino.

When $Rd_1$, $Rd_2$, $Rd_3$ or $Rd_4$ represents an alkyl group, the alkyl groups include those having a substituent and may also be straight-chained or branched.

When $Rd_1$, $Rd_2$, $Rd_3$ or $Rd_4$ represents an aryl group, the aryl groups include those having a substituent.

When $Rd_1$, $Rd_2$, $Rd_3$ or $Rd_4$ represents a heterocyclic group, the heterocyclic groups include those having a substituent, and the preferable ones include a 5- or 6-membered single or condensed ring containing at least one hetero atom selected from the group consisting of the atoms of nitrogen, oxygen and sulfur For example, these rings may be selected from the group consisting of the groups of pyridyl, quinolyl, furyl, benzothiazolyl, oxazolyl, imidazolyl, thiazolyl, triazolyl, benzotriazolyl, imido, oxazine and so forth.

In Formulas D-6 through D-8, the number of carbon atoms contained in $Rd_2$ is from 0 to 15.

In the above-given Formula D-9, the total number of carbon atoms contained in $Rd_3$ and $Rd_4$ is from 0 to 15.

—TIME—INHIBIT (D-10)

wherein the TIME group is a group capable of coupling to the coupling position of A and then cleaving the coupling upon reaction with the oxidized product of a colour developing agent, and this group is also capable of suitably controlling an INHIBIT group so as to release it after the TIME group is cleaved. The INHIBIT groups are those capable of serving as a development inhibitor upon the above-mentioned releasing, such as the groups represented by the above-given Formulas D-2 through D-9.

In Formula D-10, -TIME-INHIBIT groups may typically be represented by the following formulas D-11 through D-19.

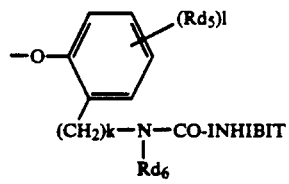
Formula D-11

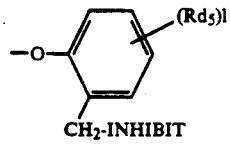
Formula D-12

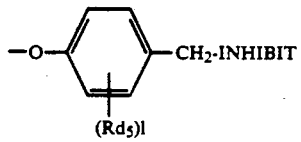
Formula D-13

-continued

Formula D-14

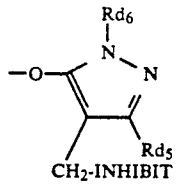

Formula D-15

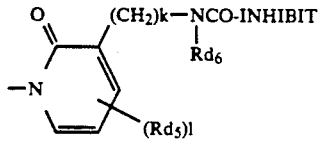

Formula D-16

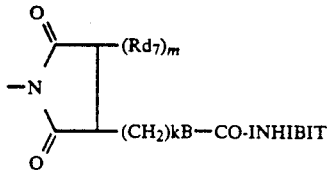

Formula D-17

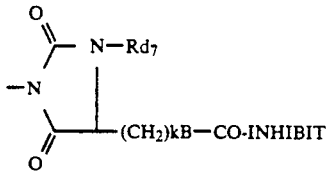

Formula D-18

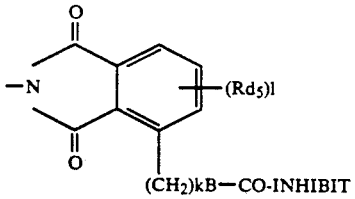

Formula D-19

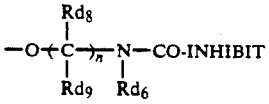

In the above Formulas D-11 through D-15 and D-18, $Rd_5$ represents a hydrogen atom, a halogen atom or a group of alkyl, cycloalkyl, alkenyl, aralkyl, alkoxy, alkoxycarbonyl, anilino, acylamino, ureido, cyano, nitro, sulfonamido, sulfamoyl, carbamoyl, aryl, carboxy, sulfo, hydroxy or alkanesulfonyl. In Formulas D-11 through D-13, D-15 and D-18, each $Rd_5$ may be coupled together to complete a condensed ring. In Formulas D-11, D-14, D-15 and D-19, $Rd_5$ represents a group of alkyl, alkenyl, aralkyl, cycloalkyl, heterocyclic or aryl. In Formulas D-16 and D-17, $Rd_7$ represents a hydrogen atom or a group of alkyl, alkenyl, aralkyl, cycloalkyl, heterocyclic or aryl. In Formula D-19, $Rd_8$ and $Rd_9$ each represent a hydrogen atom or an alkyl group including preferably those having 1 to 4 carbon atoms. In Formulas D-11 and D-15 through D-18, k is an integer of 0, 1 or 2. In Formulas D-11 through D-13, D-15 and D-18, l is an integer of from 1 to 4. In Formula D-16, m is an integer of 1 or 2 and, when m is 2, every $Rd_7$ may be the same with or different from each other. In Formula D-19, n is an integer of from 2 to 4 and n of $Rd_8$ and $Rd_9$ may be the same with or different from each other. In Formulas D-16 through D-18, B represents an oxygen atom or

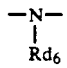

in which $Rd_6$ is synonymous with the already defined $Rd_6$. In Formula D-16, the dotted line represents either a single bond or a double bond and, in the case of a single bond, m is 2 and in the case of a double bond, m is 1, and INHIBIT group is synonymous with that defined in Formulas D-2 through D-9, except the number of carbon atoms.

In the INHIBIT group of Formulas D-2 through D-7, the number of carbon atoms contained in $R_1$ of the individual molecules is from 0 to 32 in total. In Formula D-8, the number of carbon atoms contained in $Rd_2$ is from 1 to 32. In Formula D-9, the number of carbon atoms contained in $Rd_3$ and $Rd_4$ is from 0 to 32 in total.

When $Rd_5$, $Rd_6$ and $Rd_7$ each represent a group of alkyl, aryl or cycloalkyl, they include those having a substituent.

Among the diffusible DIR compounds, the preferable ones are those having Y denoted in Formulas D-2, D-3 or D-10. In Formula D-10, the preferable INHIBIT groups are those denoted in Formulas D-2, D-6 or D-8, and they are particularly preferable when X denoted in Formula D-6 is an oxygen atom, or when $Rd_2$ denoted in Formula D-8 is hydroxyaryl group or an alkyl group having 1 to 3 carbon atoms.

In Formula D-1, the coupler components represented by A include a residual group of a yellow colour image forming coupler, magenta colour image forming coupler, cyan colour image forming coupler and non-colour forming coupler.

The diffusible DIR compounds preferably used in the invention include the following compounds. However, the invention shall not be limited thereto.

Exemplified compound D'-1

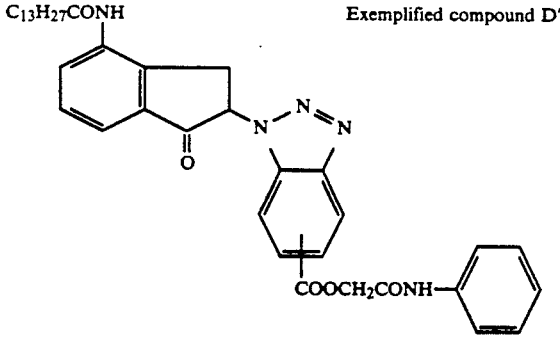

$R_1$—COCHCO—$R_2$ (Y)

| Exemplified compound No. | $R_1$ | $R_2$ | $R_3$ |
|---|---|---|---|
| D'-2 | (1) | (1) | (30) |
| D'-3 | (2) | (3) | (30) |
| D'-4 | (2) | (4) | (30) |
| D'-5 | (5) | (6) | (31) |
| D'-6 | (2) | (4) | (32) |
| D'-7 | (2) | (3) | (32) |
| D'-8 | (7) | (8) | (33) |

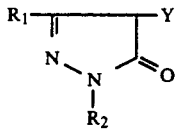
| Exemplified compound No. | $R_1$ | $R_2$ | $R_3$ |
|---|---|---|---|
| D'-9 | (9) | (10) | (30) |
| D'-10 | (11) | (10) | (30) |
| D'-11 | (12) | (7) | (34) |
| D'-12 | (12) | (13) | (35) |
| D'-13 | (9) | (14) | (36) |
| D'-14 | (15) | (16) | (37) |
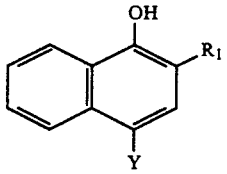
| Exemplified compound No. | $R_1$ | Y |
|---|---|---|
| D'-15 | (17) | (38) |
| D'-16 | (17) | (39) |
| D'-17 | (18) | (40) |
| D'-18 | (20) | (41) |
| D'-19 | (18) | (42) |
| D'-20 | (18) | (43) |
| D'-21 | (18) | (44) |
| D'-22 | (18) | (45) |
| D'-23 | (19) | (40) |
| D'-24 | (21) | (47) |
| D'-25 | (21) | (48) |
| D'-26 | (22) | (49) |
| D'-27 | (22) | (50) |
| D'-28 | (22) | (51) |
| D'-29 | (23) | (52) |
| D'-30 | (18) | (53) |
| D'-31 | (18) | (54) |
| D'-32 | (23) | (49) |
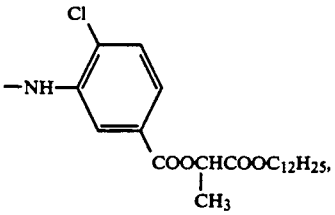
(1)
$-C(CH_3)_3$, (2)
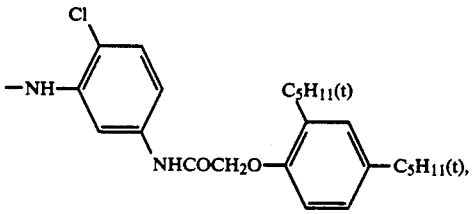
(3)
-continued
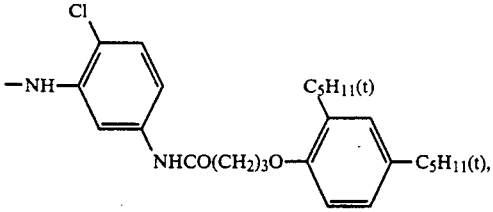
(4)
$-OCH_3$, (5)
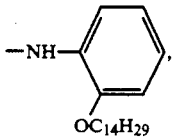
(6)
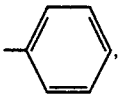
(7)
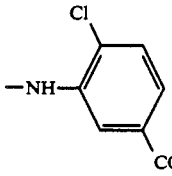
(8)
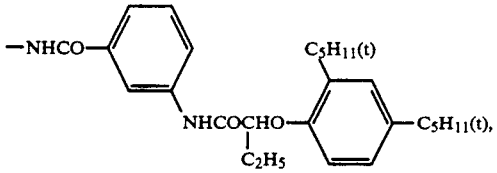
(9)
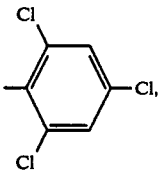
(10)
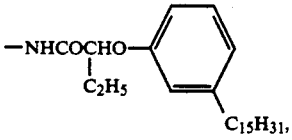
(11)
$-C_{17}H_{35}$, (12)
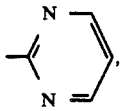
(13)
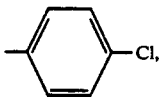
(14)
$-CH_3$, (15)

-continued
(16)
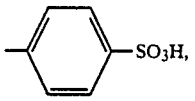
(17) $-CONHC_{18}H_{37}$,
(18)
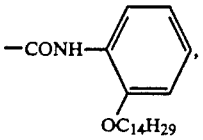
(19)
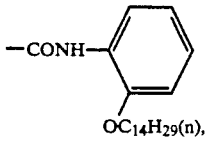
(20)
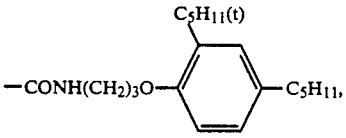
(21)
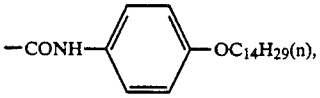
(22) $-CONHCH_2CH_2COOH$
(23) $-CONHCH_2CH_2COOCH_3$
(30)
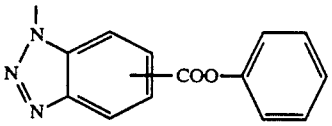
(31)
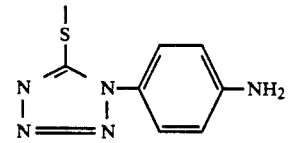
(32)
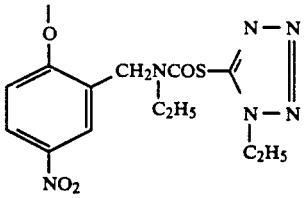
(33)
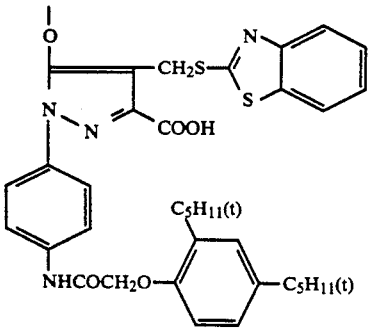
-continued
(34)
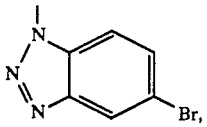
(35)
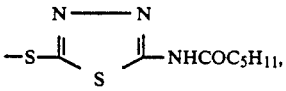
(36)
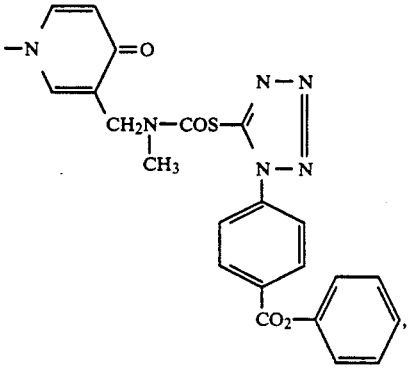
(37)
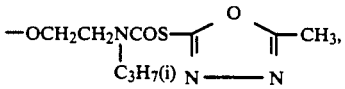
(38)
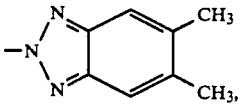
(39)
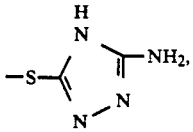
(40)
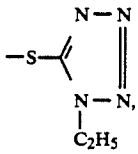
(41)
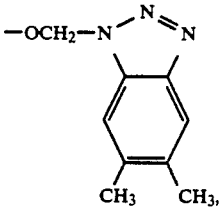
(42)
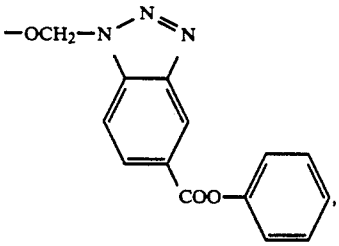

-continued (43)

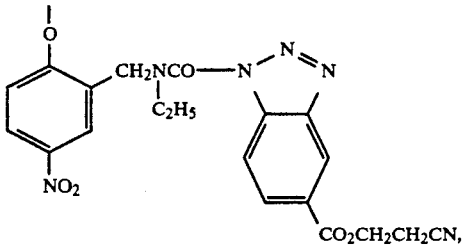

(44)

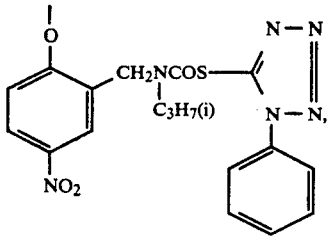

(45)

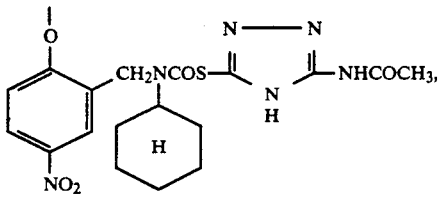

(46)

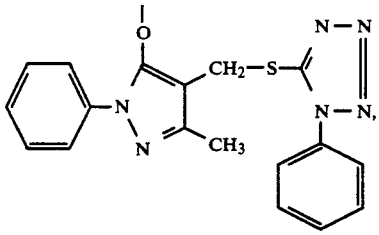

(47)

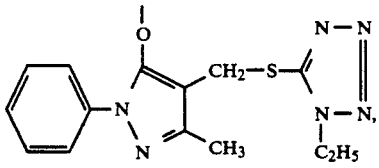

(48)

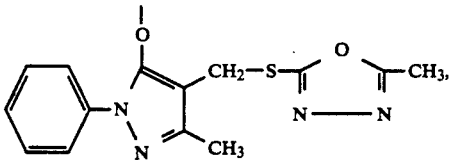

(49)

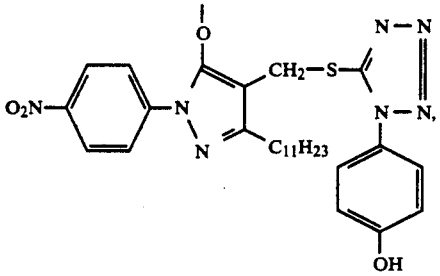

-continued (50)

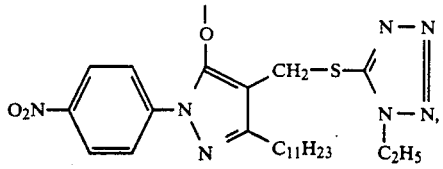

(51)

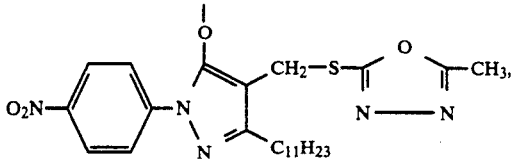

(52)

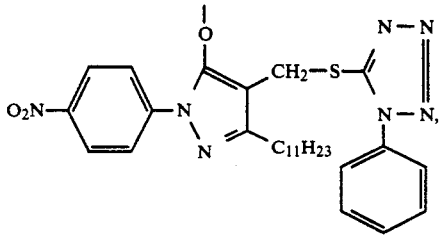

(53)

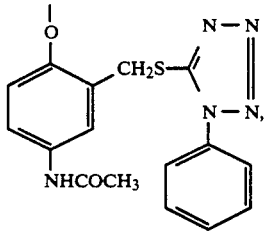

(54)

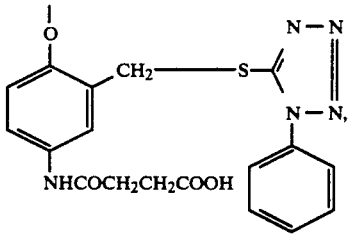

The typical examples of the diffusible DIR compounds applicable to the invention, including the above-given exemplified compounds, may readily be synthesized in such a method as described in U.S. Pat. Nos. 4,234,678, 3,227,554, 3,617,291, 3,958,993, 4,149,886 and 3,933,500; Japanese Patent O.P.I. Publication Nos. 56837-1982 and 13239-1976; U.S. Pat. Nos. 2,072,363 and 2,070,266; Research Disclosure, No. 21228, December, 1981; and so forth.

In the invention, the diffusible DIR compound may be suitably used in an amount of from 0.0001 to 0.1 mole and more preferably from 0.001 to 0.05 mole, per mole of silver used.

In the invention, a colloidal layer is formed on the surface side of the silver halide emulsion layer provided to the furthermost side from a support, and the colloidal layer contains fine-grain silver halide grains which are not substantially sensitive to light. The colloidal layer is formed generally as the protective layer of photographic component layers. The expression, 'silver halide grains not substantially sensitive to light' used herein means silver halide grains which cannot substantially be developed with a developer solution. Any silver halide grains may be used, if they can satisfy the above-mentioned interpretation of the expression.

In addition, it is more preferable that such silver halide grains may substantially be neither developed with nor dissolved in any developer. The words, 'fine-grained', means a grain size in which a light scattering can be reduced to the utmost. The average grain size of the above-mentioned silver halide grains is preferably not larger than 0.3 μm. more preferably from 0.1 to 0.2 μm and further preferably from 0.02 to 0.15 μm. The grain distribution may be either wide or narrow, and a narrow grain distribution is rather preferable.

As for the silver halide grains capable of serving as the silver halide grains not substantially sensitive to light, they include any of the grains of silver chloride, silver bromide, silver iodide, silver iodobromide, silver chloro- bromide, silver chloroiodobromide of the like. These silver halide grains may also be used independently or in combination. From the viewpoint of solubility of the silver halide grains, silver halides containing silver bromide may be preferably be used and, among which, silver iodobromide having a silver iodide content of not more than 15 mole % is more preferable, those having a silver iodide content of 1 to 10 mole % is further preferable, and those having a silver iodide content of 2 to 8 mole % is particularly preferable. The above-mentioned silver halide grains may be either physically ripened with thiocyanogen ion, cyano ion, thiocyanate ion or the like, or etched with a silver halide solvent, these silver halide grains may be prepared in various processes such as a neutral process, a half-ammonia process, an ammonia process and so forth, and in various modes such as a double-jet precipitation mode, a conversion mode and so forth.

The silver halides of non-light-sensitive layers may be H coated in an amount of preferably from 0.1 to 3.0 $g/m^2$, more preferably from 0.3 to 2.0 $g/m^2$, and further preferably from 0.5 to 1.0 $g/m^2$, provided that the above-mentioned amount to be coated is in terms of silver.

To the above-mentioned non-light-sensitive layers, it is allowed to apply, at the same time, matting agents such as colloidal silica, polymethyl methacrylate and so forth, high boiling solvents such as tricresyl phosphate, dioctyl phthalate and so forth, UV absorbents, antioxidants, lipophilic components such as a hydroquinone derivative, coating assistants such as a surface active agent, gelatin hardening emulsions, and so forth.

Gelatin is generally used as a binder for the above-mentioned non-light-sensitive layers. It is, however, allowed to substitute the gelatin partially or whole with colloidal albumin, agar, gum arabic, alginic acid, a cellulose derivative or a synthetic binder, a water-soluble polymer, a gelatin derivative, a substance in which a monomer having a polymerizable ethylene group is graft copolymerized with gelatin.

Supports of the invention may be of any materials, provided that they may be able to support photographic component layers, and they may be either transparent or opaque. Various kinds of materials may be so selected as to serve as the supports, according to the purposes.

To the above-mentioned photographic component layers, various kinds of additives may be added. According to the purposes, for example, it is also allowed to add thereto with a variety of photographic additives such as a wetting agent, a physical property improving agent for layers, a coating assistant and so forth. Besides the above-given additives, a gelatin plasticizer, a surface active agent, a UV absorbent, a pH adjusting agent, an antioxidant, an antistatic agent, a thickening agent, a graininess improving agent, a dyestuff, a mordant, a whitening agent, a developing rate adjusting agent, a matting agent and so forth, each may be used as the other photographic additives.

It is also advantageous to use a UV absorbent for preventing a dye image from colour-fading caused by an active rays of light of short wavelengths. The above-mentioned UV absorbents include, for example, the compounds of thiazolidone, benzotriazole, acrylonitrile or benzophenone.

To the silver halide emulsion layers used in the above-mentioned light-sensitive materials, it is allowed to apply suitable gelatin derivatives, in addition to gelatin, as a protective colloid or binder, according to the purposes. The above-mentioned silver halide emulsion layers may also contain other hydrophilic binders according to the purposes. In the above-mentioned light-sensitive materials, such a hydrophilic binder may also be contained in the emulsion layers or such a photographic component layer as an inter-layer, protective layer, filter layer, backing layer or the like, according to the purposes. Further, the above-mentioned hydrophilic binders may contain a suitable plasticizer, wetting agent and the like, according to the purposes.

The silver halide colour photographic light-sensitive materials relating to the invention are suitable for negative type photographic light-sensitive materials, in particular.

EXAMPLES

Now, the typical examples of the invention will be described below. It is, however, to be understood that any embodiments of this invention shall not be limited thereto.

In all the examples described below, every amount added to a silver halide photographic light-sensitive material is denoted in terms of an amount per sq. meter, unless otherwise expressly stated. The amounts of every silver halide and colloidal silver are also denoted in terms of the silver used therein.

Each of the following layers having the compositions shown below was provided over to a triacetyl cellulose film support in order from the support side, so that multilayered colour photographic light-sensitive material sample No. 1 was prepared.

Sample No. 1 for comparative purpose

- Layer 1: An antihalation layer, HC-1, i.e., a gelatin layer containing black colloidal silver
- Layer 2: An interlayer, I.L., i.e., a gelatin layer containing an emulsified dispersion of 2,5-di-t-octyl hydroquinone
- Layer 3: A low-speed red-sensitive silver halide emulsion layer, RL-1, which comprises,
  - A monodispersed emulsion, Emulsion I, having an average grain size $\bar{r}$ of 0.40 μm and a AgBrI content of 6 mole % in terms of AgI . . . In a silver coating weight of 1.8 $g/m^2$,
  - Spectral sensitizer I . . . In $5.0\times10^{-4}$ mole per mole of silver,
  - Spectral sensitizer II . . . In $0.8\times10^{-4}$ mole per mole of silver, Cyan coupler C-1 . . . In 0.85 mole per mole of silver, Coloured cyan coupler CC-1 . . . In 0.005 mole per mole of silver, DIR compound D'-23 . . . In 0.0015 mole per mole of silver, and DIR compound D'-25 . . . In 0.002 mole per mole of silver.

Layer 4: A high-speed red-sensitive silver halide emulsion layer, RH-1, which comprises, A monodispersed emulsion, Emulsion II, having an average grain size $\bar{r}$ of 0.8 μm and a AgBrI content of 6.0 mole % in terms of AgI . . . In a silver coating weight of 1.3 g/m$^2$, Spectral sensitizer I . . . In 2.5 $\times 10^{-4}$ mole per mole of silver, Spectral sensitizer II . . . In $0.8\times 10^{-4}$ mole per mole of silver, Cyan coupler C-2 . . . In 0.07 mole per mole of silver, Cyan coupler C-3 . . . In 0.027 mole per mole of silver, Coloured cyan coupler CC-I . . . In 0.0015 mole per mole of silver, and DIR compound D'-25 . . . In 0.001 mole per mole of silver.

Layer 5: An interlayer, I.L., i.e., a gelatin layer which is the same as Layer 2.

Layer 6: A low-speed green-sensitive silver halide emulsion, GL-1, which comprises.

Emulsion-I . . . In a silver coating weight of 1.5 g/m$^2$,

Spectral sensitizer III . . . In $2.0\times 10^{-4}$ mole per mole of silver,

Spectral sensitizer IV . . . In $1.0\times 10^{-4}$ mole per mole of silver,

Magenta coupler M-1 . . . In 0.090 mole per mole of silver,

Coloured magenta coupler CM-1 . . . In 0.004 mole per mole of silver,

DIR compound D'-23 . . . In 0.0010 mole per mole of silver, and

DIR compound D'-32 . . . In 0.0030 mole per mole of silver.

Layer 7: A high-speed green-sensitive silver halide emulsion layer. GH-1, which comprises.

Emulsion-II . . . In a silver coating weight of 1.4 g/m$^2$,

Spectral sensitizer III . . . In $1.2\times 10^{-4}$ mole per mole of silver,

Spectral sensitizer IV . . . In $0.8\times 10^{-4}$ mole per mole of silver,

Magenta coupler M-1 . . . In 0.015 mole per mole of silver,

Coloured magenta Coupler CM-1 . . . In 0.002 mole per mole of silver, and

DIR compound D'-32 . . . In 0.0010 mole per mole of silver.

Layer 8: A yellow filter layer. YC-1, i.e., a gelatin layer containing yellow colloidal silver and an emulsified dispersion of 2,5-di-t-octyl hydroquinone.

Layer 9: A low-speed blue-sensitive silver halide emulsion layer, BL-1, which comprises, A monodispersed emulsion. Emulsion IV, having an average grain size of 0.48 μm and a AgBrI content of 6 mole % in terms of AgI . . . In a silver coating weight of 0.9 g/m$^2$, Spectral sensitizer V . . . In $1.3\times 10^{-4}$ mole per mole of silver, Yellow coupler Y-1 . . . In 0.29 mole per mole of silver.

Layer 10: A high-speed blue-sensitive silver halide emulsion layer, BH-1, which comprises, A monodispersed emulsion. Emulsion IV, having an average grain size of 0.8 μm and a AgBrI content of 7 mole % in terms of AgI . . . In a silver coating weight of 0.5 g/m$^2$, Spectral sensitizer V . . . In $1.0\times 10^{-4}$ mole per mole of silver, Yellow coupler Y-1 . . . In 0.08 mole per mole of silver, and DIR compound D'-25 . . . In 0.0030 mole per mole of silver.

Layer II: The first protective layer, Pro-1, i.e., a gelatin layer containing silver halide grains shown in Table-1 and UV absorbents UV-1 and UV-2.

Layer 12: The second protective layer, Pro-2, having a layer thickness of 0.7 μm, i.e., a gelatin layer containing polymethyl methacrylate grains having a grain size of 1.5 μm and formalin scavenger HS-1.

To each of the layers, gelatin hardeners, H-1 and H-2, and a surface active agent, besides the above-mentioned compositions, were added.

The compounds added to each of the layers of Sample No. 1. were as follows.

Spectral sensitizer I:

Andro-5,5'-dichloro-9-ethyl-3,3'-di-(3-sulfopropyl)thiacarbocyanine hydroxide

Spectral sensitizer II:

Anhydro-9-ethyl-3,3'-di-(3-sulfopropyl)-4,5,4',5'-dibenzothiacarbocyanine hydroxide

Spectral sensitizer III:

Anhydro-5,5'-diphenyl-9-ethyl-3,3'-di-(3-sulfopropyl)oxacarbocyanine hydroxide

Spectral sensitizer IV:

Anhydro-9-ethyl-3,3'-di-(3-sulfopropyl)-5,6,5',6'-dibenzoxacarbocyanine hydroxide

Spectral sensitizer V:

Anhydro-3,3'-di-(3-sulfopropyl)-4,5 -benzo-5'-methoxythiacyanine anhydroxide

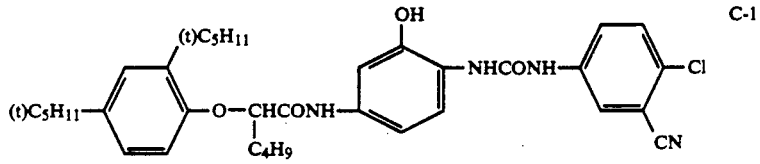

-continued
C-2
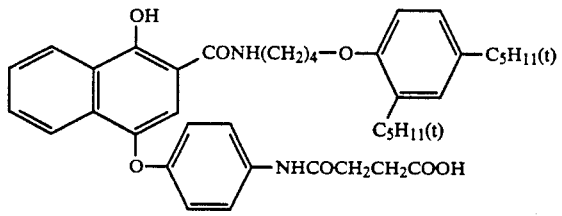
C-3
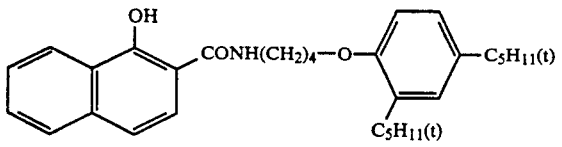
CC-1
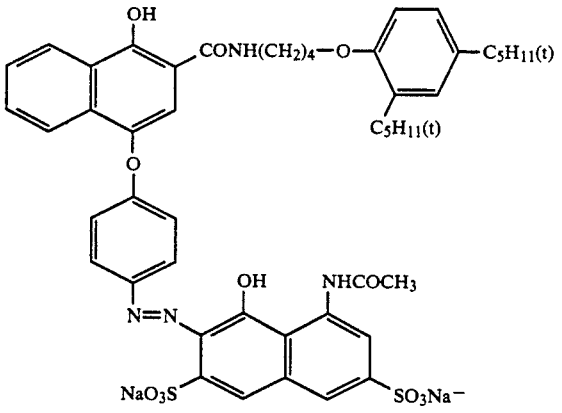
D'-23
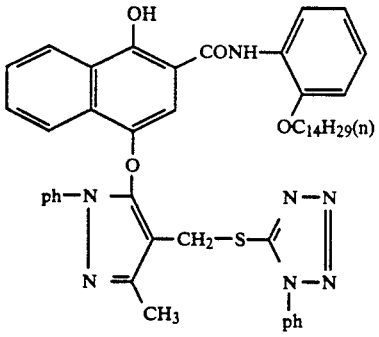
D'-25
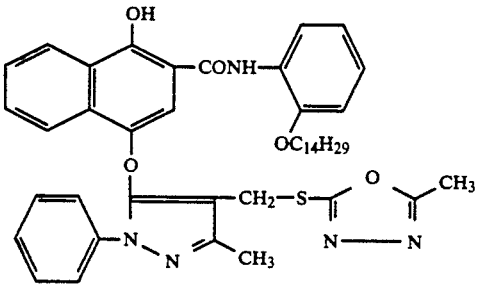

-continued
D'-32
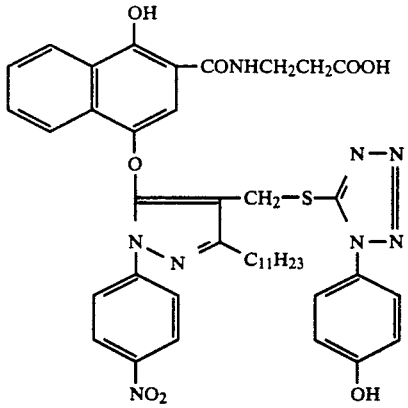
M-1
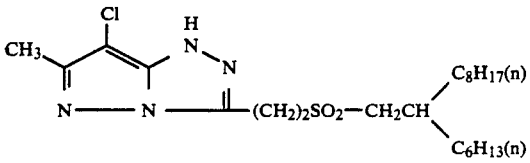
CM-1
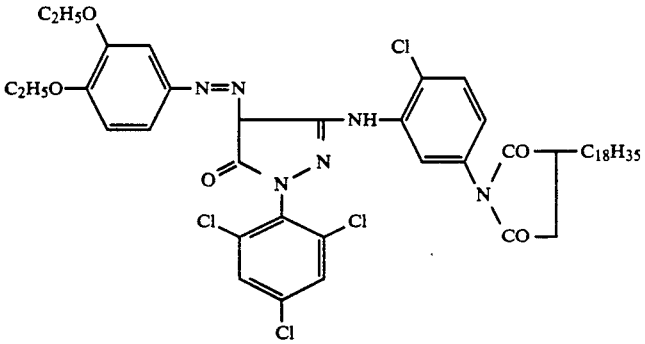
Y-1
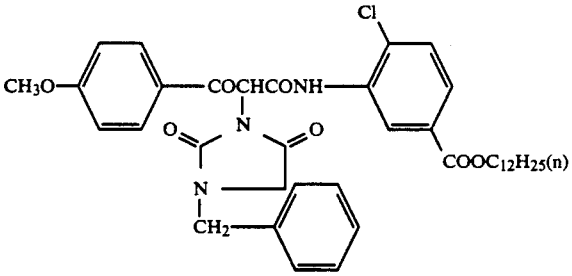
UV-1
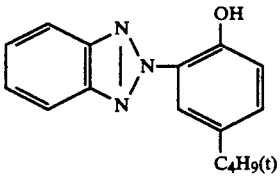
UV-2
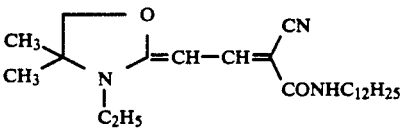
HS-1
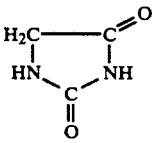

-continued
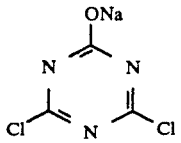
H-1
$[(CH_2{=}CHSO_2CH_2)_3CCH_2SO_2(CH_2)_2]_2N$
$\quad\quad\quad

TABLE 2

| Sample No. | Sharpness MTF (%) | Red color reproducibility | | | Green color reproducibility | | | Invention or not |
|---|---|---|---|---|---|---|---|---|
| | | Blue density | Green density | Red density | Blue density | Green density | Red density | |
| 1 | 100 | 1.54 | 1.29 | 0.36 | 1.19 | 0.75 | 1.16 | Comp. |
| 2 | 112 | 1.54 | 1.35 | 0.36 | 1.22 | 0.75 | 1.27 | Comp. |
| 3 | 117 | 1.57 | 1.58 | 0.35 | 1.27 | 0.74 | 1.36 | Inv. |
| 4 | 119 | 1.57 | 1.62 | 0.35 | 1.29 | 0.74 | 1.40 | Inv. |
| 5 | 123 | 1.58 | 1.65 | 0.35 | 1.32 | 0.74 | 1.45 | Inv. |
| 6 | 125 | 1.59 | 1.67 | 0.35 | 1.34 | 0.73 | 1.48 | Inv. |
| 7 | 126 | 1.60 | 1.70 | 0.35 | 1.35 | 0.73 | 1.50 | Inv. |
| 8 | 122 | 1.57 | 1.59 | 0.35 | 1.27 | 0.74 | 1.37 | Inv. |
| 9 | 122 | 1.57 | 1.62 | 0.35 | 1.30 | 0.74 | 1.40 | Inv. |
| 10 | 125 | 1.59 | 1.67 | 0.35 | 1.34 | 0.73 | 1.48 | Inv. |
| Standard chart | | 1.63 | 1.75 | 0.34 | 1.36 | 0.70 | 1.52 | |

As is obvious from the above Table-2, when the layer thickness ($D_T$) of a photographic component layer is not thicker than 16 μm. every sample is improved in sharpness as Sample No. 1 is compared to the other samples. In Samples No. 3 through No. 10 relating to the invention whose Layer 11 contained a silver halide, it is also found that they are excellent in sharpness and remarkable in the improvement of colour contamination, as well as high in the fidelity of colour reproducibility. It is further found that the effects of the invention is greater in the case of Samples No. 5 to No. 10 whose Layer 11 contained a non-light-sensitive fine-grain silver halide in an amount of not less than 0.50 g/m$^2$, as compared to Samples No. 4 and No. 5 containing relatively less amount of the same silver halide; that it is also greater in the case of Samples No. 6, 7, 9 and 10 each having an average grain size of fine-grain silver halides of not larger than 0.5μ; and that it is particularly greater in the case of Samples No. 6, 7 and 10 whose halogen composition of fine-grain silver halides is silver iodobromide containing silver iodide of 2 to 8 mole %.

According to the invention, it is possible to obtain a silver halide colour photographic light-sensitive material excellent in both sharpness and colour reproducibility.

What is claimed is:

1. A silver halide color photographic light-sensitive material comprising (i) a support (ii) photographic component layers having a total dry thickness of from about 5 μm to 15.1 μm and comprising a red light-sensitive silver halide emulsion layer containing a cyan coupler, a green light-sensitive halide emulsion layer containing a magenta coupler and a blue light sensitive silver halide emulsion layer containing a yellow coupler; and (iii) a colloidal layer containing substantially non light sensitive fine-grain silver halide grains having an average grain size of not larger than about 0.3 μm, said colloidal layer being positioned farther from said support than said photographic component layers, wherein at least one of said silver halide emulsion layers contains a diffusible DIR compound and the total silver halide content of said silver halide emulsion layers is from 3.0 g/m$^2$ to 6.0 g/m$^2$ of silver.

2. The silver halide color photographic light-sensitive material of claim 1, wherein said total dry-thickness of said photographic component layers is within the range of from 10 μm to 15 μm.

3. The silver halide color photographic light-sensitive material of claim 1, wherein said total silver halide content of said silver halide emulsion layers is within the range of from 3.5 g/m$^2$ to 5.5 g/m$^2$ of silver.

4. The silver halide color photographic light-sensitive material of claim 3, wherein said total silver halide content of said silver halide emulsion layers is within the range of from 4.0 g/m$^2$ to 5.0 g/m$^2$ of silver.

5. The silver halide color photographic light-sensitive material of claim 1, wherein said diffusible DIR compound has a development inhibiting group or a group capable of releasing a development inhibitor, each of which is capable of splitting off upon reaction with the oxidized product of a color developing agent and has a diffusibility of not less than 0.40.

6. The silver halide color photographic light-sensitive material of claim 1, wherein said diffusible DIR compound is represented by the formula D-1:

$$A—(Y)m \qquad \text{D-1}$$

wherein A represents a coupler residue, m i an integer of 1 or 2 and Y represents a development inhibiting group or a group capable of releasing a developing inhibitor, each of which has a diffusibility of not less than 0.40, is bonded to the coupling position of said coupler residue, and is capable of splitting off from said coupler residue upon reaction with the oxidized product of a color developing agent.

7. The silver halide color photographic light-sensitive material of claim 1, wherein said DIR compound is present in amounts ranging from 0.001 mole to 0.1 mole per mole of silver in said silver halide emulsion layers.

8. The silver halide color photographic light-sensitive material of claim 7, wherein said DIR compound is present in amounts ranging from 0.001 mole to 0.05 mole per mole of silver in said silver halide emulsion layers.

9. The silver halide color photographic light-sensitive material of claim 1, wherein said fine-grain silver halide grains have an average size ranging from 0.01 μm to 0.2 μm.

10. The silver halide color photographic light-sensitive material of claim 9, wherein said fine-grain silver halide grains have an average size ranging from 0.02 μm to 0.15 μm.

11. The silver halide color photographic light-sensitive material of claim 1, wherein said fine-grain silver halide grains contain silver bromide.

12. The silver halide color photographic light-sensitive material of claim 11, wherein said fine-grain silver halide grains are silver bromoiodide containing not more than 15 mole % of silver iodide.

13. The silver halide color photographic light-sensitive material of claim 12, wherein said fine-grain silver halide grains are silver bromoiodide containing 1 to 10 mole % of silver iodide.

14. The silver halide color photographic light-sensitive material of claim 13, wherein said fine-grain silver halide grains are silver bromoiodide containing 2 to 8 mole % of silver iodide.

15. The silver halide color photographic light-sensitive material of claim 1, wherein a coating weight of said fine-grain silver halide grains ranges from 0.1 $g/m^2$ to 3.0 $g/m^2$ of silver.

16. The silver halide color photographic light-sensitive material of claim 15, wherein said coating weight of said fine-grain silver halide grains ranges from 0.3 $g/m^2$ to 2.0 $g/m^2$ of silver.

17. The silver halide color photographic light-sensitive material of claim 16, wherein said coating weight of said fine-grain silver halide grains ranges from 0.5 $g/m^2$ to 1.0 $g/m^2$ of silver.

* * * * *

UNITED STATES PATENT AND TRADEMARK OFFICE

CERTIFICATE OF CORRECTION

PATENT NO. : 5,009,988

DATED : April 23, 1991

INVENTOR(S) : Toshihiko Yagi et al

It is certified that error appears in the above-identified patent and that said Letters Patent is hereby corrected as shown below:

Claim 6, column 30, line 41, change "i" to --is--.

Claim 7, column 30, line 51, change "0.001" to --0.0001--.

Signed and Sealed this

Second Day of March, 1993

*Attest:*

STEPHEN G. KUNIN

*Attesting Officer*

*Acting Commissioner of Patents and Trademarks*